US007573433B2

(12) United States Patent
Qin

(10) Patent No.: US 7,573,433 B2
(45) Date of Patent: Aug. 11, 2009

(54) DUAL-BAND ANTENNA AND MIMO ANTENNA USING THE SAME

(75) Inventor: Xiang-Hong Qin, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 294 days.

(21) Appl. No.: 11/616,886

(22) Filed: Dec. 28, 2006

(65) Prior Publication Data

US 2008/0088509 A1 Apr. 17, 2008

(30) Foreign Application Priority Data

Oct. 13, 2006 (CN) ..... 2006 1 0200991

(51) Int. Cl.
*H01Q 1/38* (2006.01)
*H01Q 9/28* (2006.01)
*H01Q 5/01* (2006.01)

(52) U.S. Cl. ..... 343/795; 343/727; 343/829

(58) Field of Classification Search ..... 373/700 MS, 373/727, 795, 829, 846

See application file for complete search history.

(56) References Cited

U.S. PATENT DOCUMENTS 5,426,439 A * 6/1995 Grossman ..... 343/727
6,496,148 B2 12/2002 Ngounou Kouam et al.

FOREIGN PATENT DOCUMENTS

TW 527749 4/2003
TW M253918 12/2004

* cited by examiner

*Primary Examiner*—Michael C Wimer
(74) *Attorney, Agent, or Firm*—Wei Te Chung

(57) ABSTRACT

A dual-band antenna (10) is disposed on a substrate (200). The substrate includes a first surface (210) and a second surface (220). The dual antenna includes a feeding portion (110), a first radiation portion (120), a second radiation portion (130), a first grounded portion (140) , a second grounded portion (150), and a connecting portion (160). The feeding portion is disposed on the first surface, for feeding electromagnetic signals. The first radiation portion, disposed on the first surface, is electronically connected to the feeding portion. The second radiation portion, disposed on the second surface, is electronically connected to the feeding portion. The first grounded portion is disposed on one side of the feeding portion. The second grounded portion is disposed on the other side of the feeding portion. The connecting portion is for electronically connecting the first radiation portion, the second radiation portion, and the feeding portion.

17 Claims, 8 Drawing Sheets

DUAL-BAND ANTENNA AND MIMO ANTENNA USING THE SAME

BACKGROUND

1. Field of the Invention

The present invention relates to antennas, and particularly to a dual-band antenna and a multi input multi output (MIMO) antenna using the same.

2. Related Art

Recently, there has been significant growth in MIMO technology due to the ever growing demand of wireless communication products. MIMO antennas are widely used in the field of wireless technology. A MIMO antenna includes many antennas. Every antenna should be designed as small as possible and the isolation between antennas should be designed to satisfy space and radiation requirements of wireless local area network (WLAN) devices.

Therefore, a heretofore unaddressed need exists in the industry to overcome the aforementioned deficiencies and inadequacies.

SUMMARY

An exemplary embodiment of the present invention provides a dual-band antenna. The dual-band antenna is disposed on a substrate. The substrate includes a first surface and a second surface. The dual-band antenna includes a feeding portion, a first radiation portion, a second radiation portion, a first grounded portion, a second grounded portion, and a connecting portion. The feeding portion is disposed on the first surface, for feeding electromagnetic signals. The first radiation portion disposed on the first surface is electronically connected to the feeding portion. The second radiation portion disposed on the second surface is electronically connected to the feeding portion. The first grounded portion is disposed on one side of the feeding portion. The second grounded portion is disposed on the other side of the feeding portion. The connecting portion is for electronically connecting the first radiation portion, the second radiation portion, and the feeding portion.

Another exemplary embodiment of the present invention provides a MIMO antenna. The MIMO antenna is disposed on a substrate. The substrate includes a first surface and a second surface. The MIMO antenna includes a first dual-band antenna and a second dual-band antenna symmetrically defined on the substrate. The first dual-band antenna and the second dual-band antenna each include a feeding portion, a first radiation portion, a second radiation portion, a first grounded portion, a second grounded portion, and a connecting portion. The feeding portion is disposed on the first surface, for feeding electromagnetic signals. The first radiation portion disposed on the first surface is electronically connected to the feeding portion. The second radiation portion disposed on the second surface is electronically connected to the feeding portion. The first grounded portion is disposed on one side of the feeding portion. The second grounded portion is disposed on the other side of the feeding portion. The connecting portion is for electronically connecting the first radiation portion, the second radiation portion, and the feeding portion.

Other objectives, advantages and novel features of the present invention will be drawn from the following detailed description of preferred embodiments of the present invention with the attached drawings, in which:

DETAILED DESCRIPTION OF THE EMBODIMENTS

Figure 1:
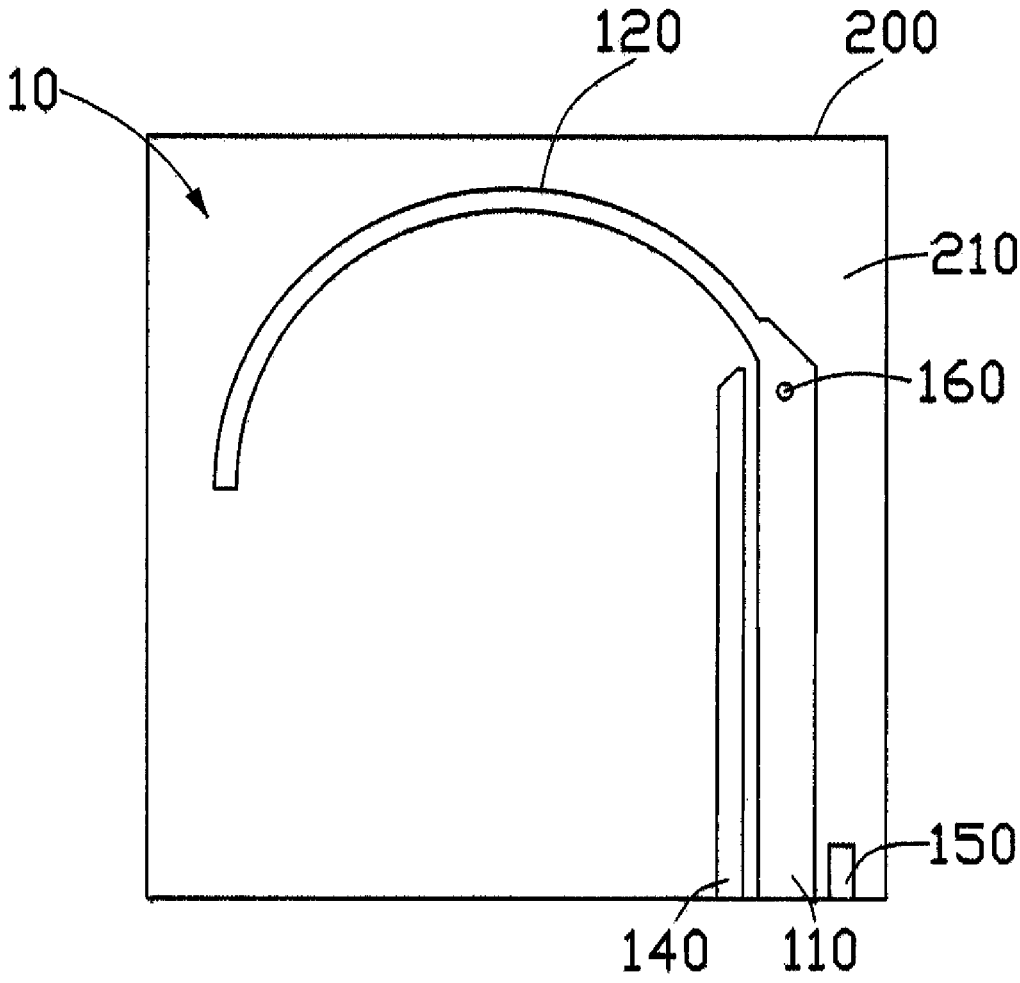
FIG. 1 is a front view schematic diagram of a dual-band antenna in accordance with an exemplary embodiment of the invention.
Figure 2:
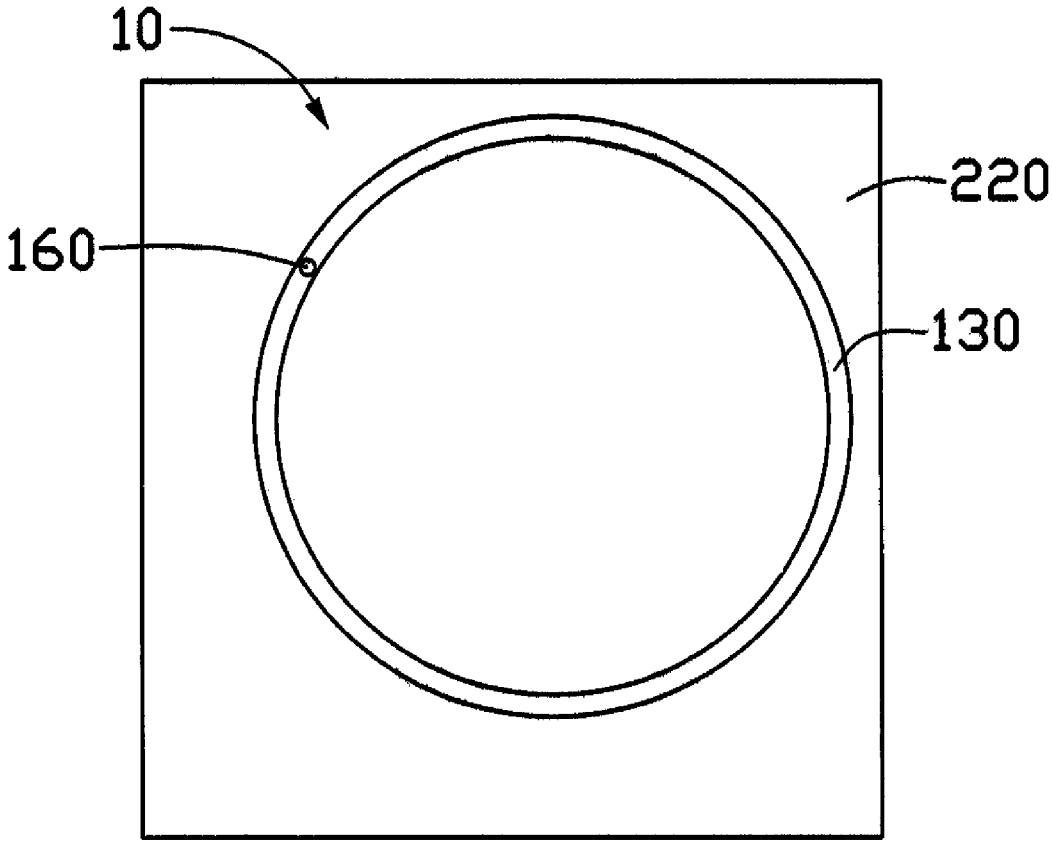
FIG. 2 is a back view schematic diagram of the dual-band antenna of FIG. 1.

FIG. 1 and FIG. 2 are respectively front and back view schematic diagrams of a dual-band antenna 10 in accordance with an exemplary embodiment of the invention.

In the exemplary embodiment, the dual-band antenna 10 is disposed on a substrate 200. The substrate 200 includes a first surface 210 (FIG. 1) and a second surface 220 (FIG. 2). The dual-band antenna 10 includes a feeding portion 110 (FIG. 1), a first radiation portion 120 (FIG. 1), a second radiation portion 130 (FIG. 2), a first grounded portion 140 (FIG. 1), a second grounded portion 150 (FIG. 1), and a connecting portion 160 (FIG. 1 and FIG. 2).

The feeding portion 110, disposed on the first surface 210, feeds electromagnetic signals. The first radiation portion 120, disposed on the first surface 210, is arc-shaped. One end of the first radiation portion 120 is electronically connected to the feeding portion 110, and the other end of the first radiation portion 120 is a free end. In this embodiment, the first radiation portion 120 operates at a frequency band of 4.9-6.0 GHz. In other embodiments, the first radiation portion 120 may operate at other commercial frequency bands by slightly modifying dimensions thereof.

The second radiation portion 130, disposed on the second surface 220, is ring-shaped, and electronically connected to the feeding portion 110. In this embodiment, the second radiation 130 operates at frequency band of 2.2-3.7 GHz. In other embodiments, the second radiation portion 130 may operate at other commercial frequency bands by slightly modifying dimensions thereof. Projections of the first radiation portion 120 and the second radiation portion 130 on the substrate 200 partially overlap.

The first grounded portion 140 is disposed on one side of the feeding portion 110, and is trapezoid-shaped. In other embodiments, the first grounded portion 140 may be elongated. The second grounded portion 150 disposed on the other side of the feeding portion 110, is elongated. The first grounded portion 140 and the first radiation portion 120 are disposed on the same side of the feeding portion 110, and a length of the first grounded portion 140 is greater than that of the second grounded portion 150.

The connecting portion 160 passes through the substrate 200, for electronically connecting the first radiation portion 120, the second radiation portion 130, and the feeding portion 110.

The feeding portion 110 is trapezoid-shaped. One end of the feeding portion 110 is electronically connected to a radio frequency module (not shown), and the other end of the feeding portion 110 is electronically connected to the first radiation portion 120 and the second radiation portion 130.

In this embodiment, one base line of the feeding portion 110 is 11 millimeter (mm), and the other base line of the feeding portion 110 is 12 mm. The inside radius and the outside radius of the first radiation portion 120 are the same as those of the second radiation portion 130. The inside radius is 5.8 mm, and the outside radius is 6.2 mm. One base line of the first grounded portion 140 is 10.6 mm, and the other base line of the first grounded portion 140 is 11 mm. A length of the second grounded portion 150 is 1.15 mm, and a width of the second grounded portion 150 is 0.5 mm.

Figure 3:
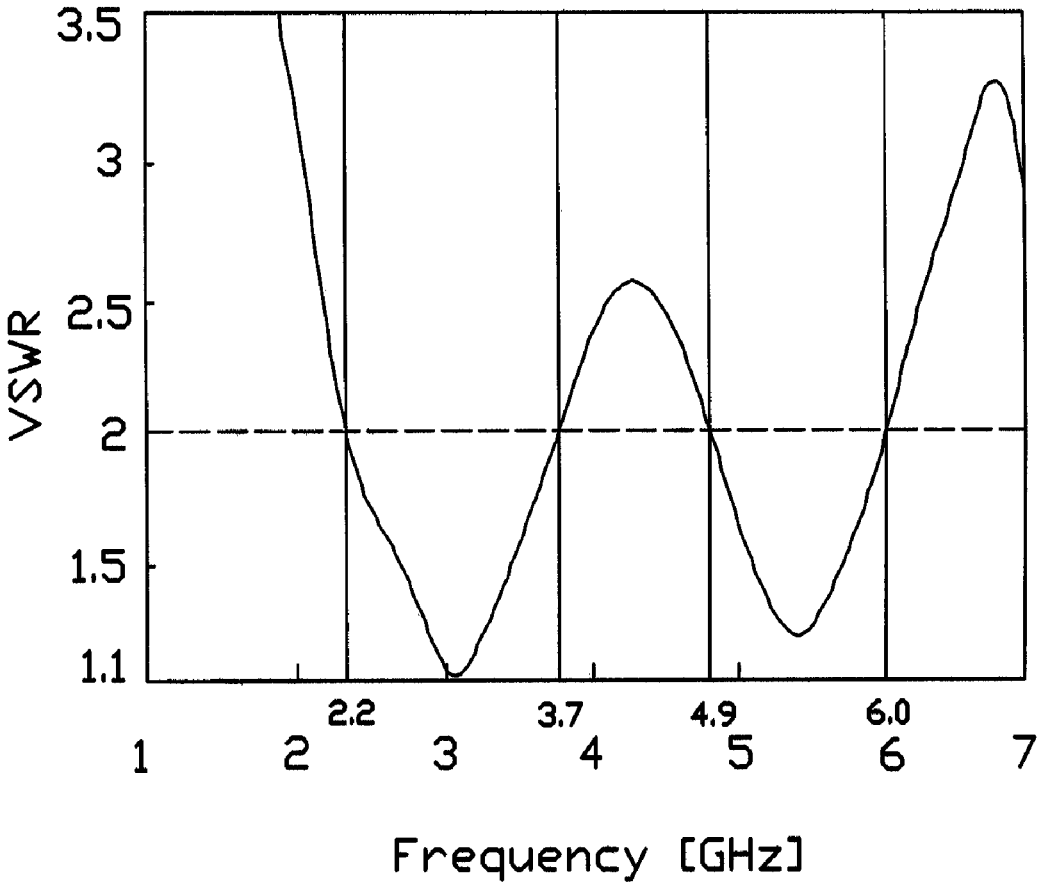
FIG. 3 is a graph of test results showing voltage standing wave ratio (VSWR) of the dual-band antenna of FIG. 1 and FIG. 2.

FIG. 3 is a graph of test results showing voltage standing wave ratio (VSWR) of the dual-band antenna 10. A horizontal axis represents the frequency (in GHz) of the electromagnetic signals traveling through the dual-band antenna 10, and a vertical axis represents amplitude of VSWR. A curve shows the amplitude of VSWR of the dual-band antenna 10 at operating frequencies. As shown in FIG. 3, the dual-band antenna 10 performs well when operating at frequency bands of 2.2-3.7 GHz and 4.9-6.0 GHz. The amplitudes of the VSWR in the band pass frequency range are smaller than a value of 2, indicating that the dual-band antenna 10 complies with application of IEEE 802.11a/b/g.

Figure 4:
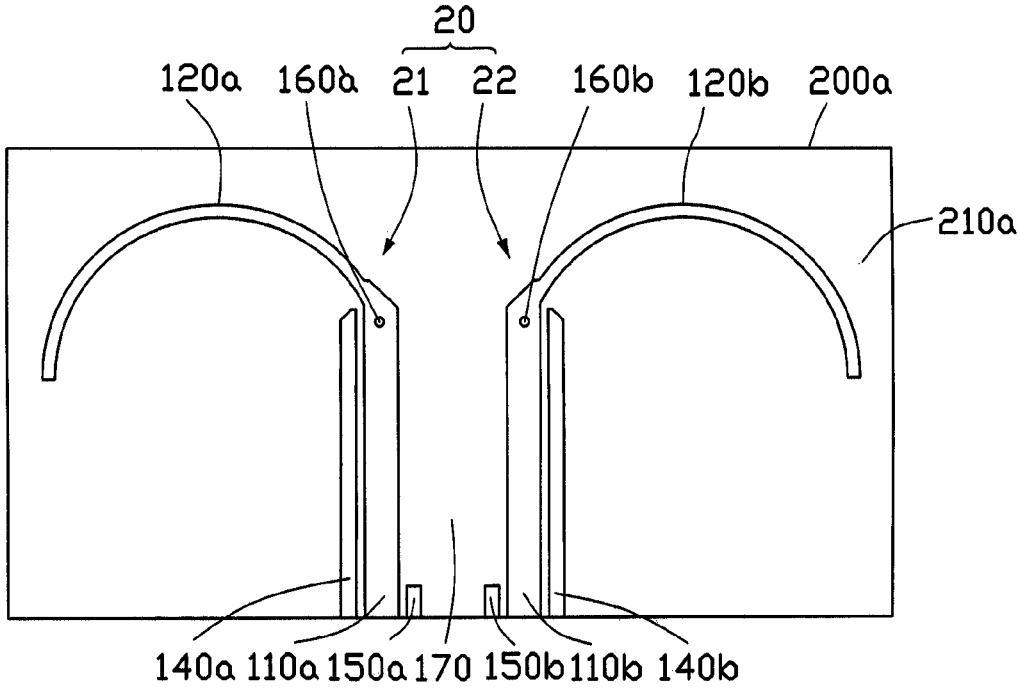
FIG. 4 is a front view schematic diagram of a multi input multi output (MIMO) antenna in accordance with another exemplary embodiment of the invention.
Figure 5:
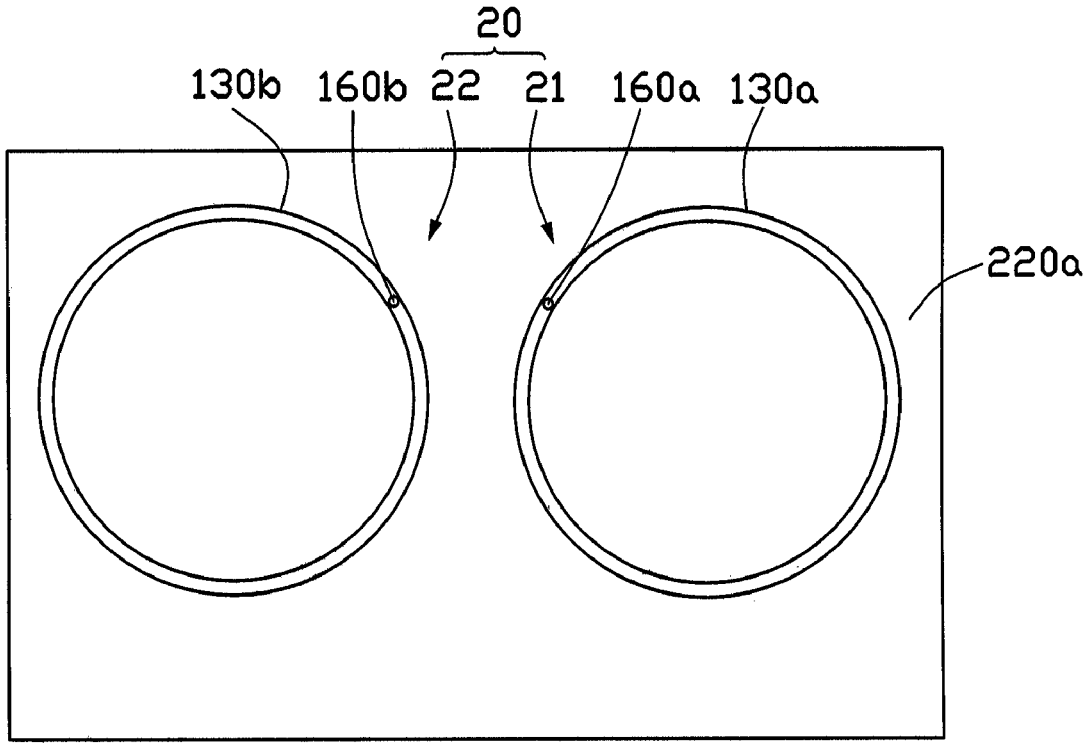
FIG. 5 is a back view schematic diagram of the MIMO antenna of FIG. 4.

FIG. 4 and FIG. 5 are respectively front and back view schematic diagrams of a multi input multi output (MIMO) antenna 20 in accordance with an exemplary embodiment of the invention.

In this embodiment, the MIMO antenna 20 is disposed on a substrate 200*a*. The substrate 200*a* includes a first surface 210*a* (FIG. 4) and a second surface 220*a* (FIG. 5). The MIMO antenna 20 includes a first dual-band antenna 21 and a second dual-band antenna 22 symmetrically formed on the substrate 200*a*. Shape, structure, and size of the first dual-band antenna 21 are the same as those of the second dual-band antenna 22.

The first dual-band antenna 21 includes a feeding portion 110*a* (FIG. 4), a first radiation portion 120*a* (FIG. 4), a second radiation portion 130*a* (FIG. 5), a first grounded portion 140*a* (FIG. 4), a second grounded portion 150*a* (FIG. 4), and a connecting portion 160*a* (FIG. 4 and FIG. 5).

The second dual-band antenna 22 includes a feeding portion 110*b* (FIG. 4), a first radiation portion 120*b* (FIG. 4), a second radiation portion 130*b* (FIG. 5), a first grounded portion 140*b* (FIG. 4), a second grounded portion 150*b* (FIG. 4), and a connecting portion 160*b* (FIG. 4 and FIG. 5).

The feeding portion 110*a* (110*b*) is disposed on the first surface 210*a*, for feeding electromagnetic signals. The first radiation portion 120*a* (120*b*), disposed on the first surface 210*a*, is electronically connected to the feeding portion 110*a* (110*b*), and is arc-shaped. The second radiation portion 130*a* (130*b*), disposed on the second surface 220*a*, is electronically connected to the feeding portion 110*a* (110*b*), and is ring-shaped. The first grounded portion 140*a* (140*b*) is disposed on one side of the feeding portion 110*a* (110*b*), and the second grounded portion 150*a* (150*b*) is disposed on the other side of the feeding portion 110*a* (110*b*). The connecting portion 160*a* (160*b*) is electronically connected to the first radiation portion 120*a* (120*b*), the second radiation portion 130*a* (130*b*), and the feeding portion 110*a* (110*b*).

One end of the first radiation portion 120*a* (120*b*) is electronically connected to the feeding portion 110*a* (110*b*), and the other end of the first radiation portion 120*a* (120*b*) is a free end. Projections of the first radiation portion 120*a* (120*b*) and the second radiation portion 130*a* (130*b*) on the substrate 200 partially overlap. The first grounded portion 140*a* (140*b*) and the first radiation portion 120*a* (120*b*) are disposed on the same side of the feeding portion 110*a* (110*b*), and a length of the first grounded portion 140*a* (140*b*) is greater than that of the second grounded portion 150*a* (150*b*).

The feeding portion 110*a* is parallel to the feeding portion 110*b*, and a vacant portion 170 is formed therebetween. The first radiation portion 120*a* is located at a side of the feeding portion 110*a* opposite to the vacant portion 170. The first radiation portion 120*b* is located at a side of the feeding portion 110*b* opposite to the vacant portion 170. The second grounded portion 150*a* is parallel to the second grounded portion 150*b*, the second grounded portion 150*a* and the second grounded portion 150*b* are located with the vacant portion 170. The connecting portion 160*a* (160*b*) passes through the substrate 200*a*.

Figure 6:
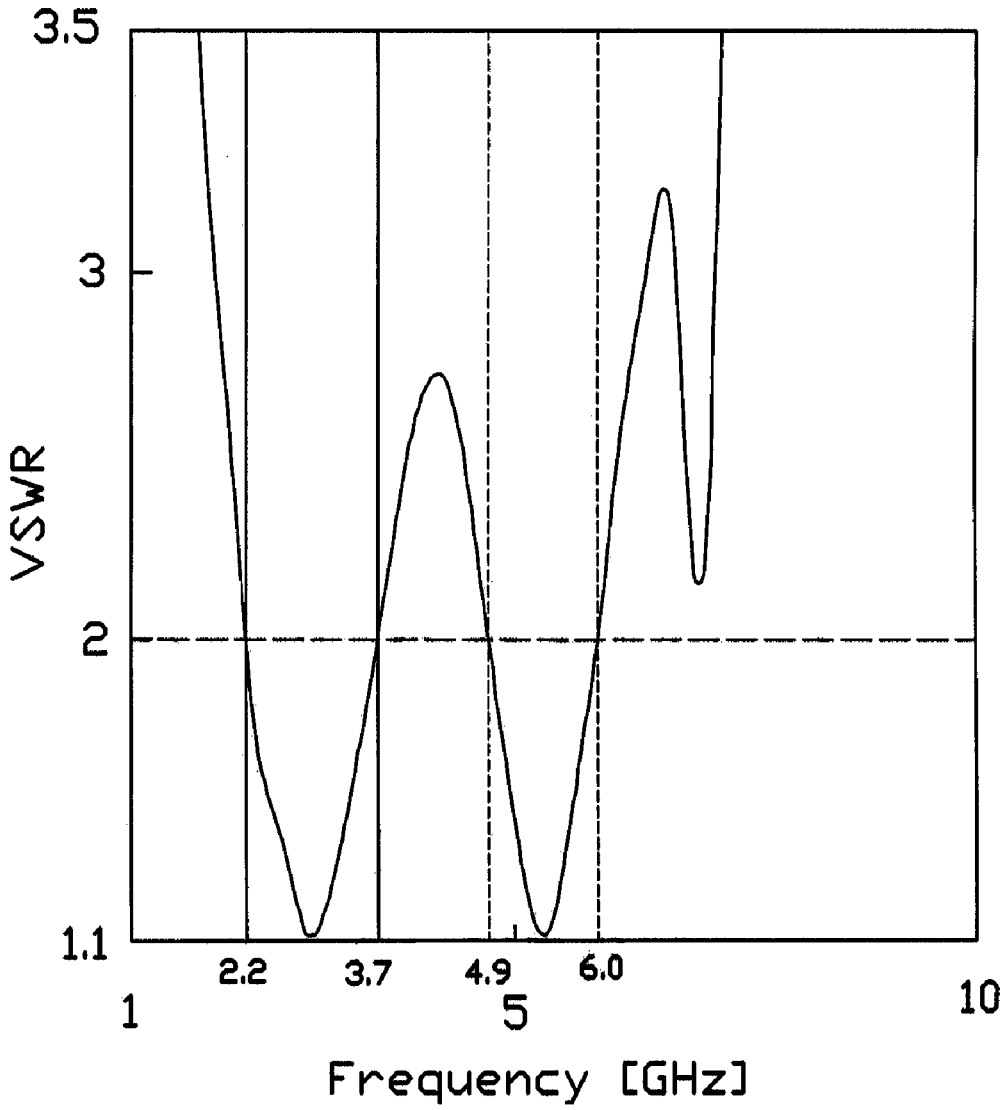
FIG. 6 is a graph of test results showing VSWR of a first dual-band antenna of the MIMO antenna of FIG. 4 and FIG. 5.

FIG. 6 is a graph of test results showing VSWR of the first dual-band antenna 21 of the MIMO antenna 20. A horizontal axis represents the frequency (in GHz) of the electromagnetic signals traveling through the first dual-band antenna 21, and a vertical axis represents amplitude of VSWR. A curve shows the amplitude of VSWR of the first dual-band antenna 21 at operating frequencies. As shown in FIG. 6, the first dual-band antenna 21 performs well when operating at frequency bands of 2.2-3.7 GHz and 4.9-6.0 GHz. The amplitude values of the VSWR in the band pass frequency range are smaller than a value of 2, indicating the first dual-band antenna 21 complies with application of IEEE 802.11a/b/g.

Figure 7:
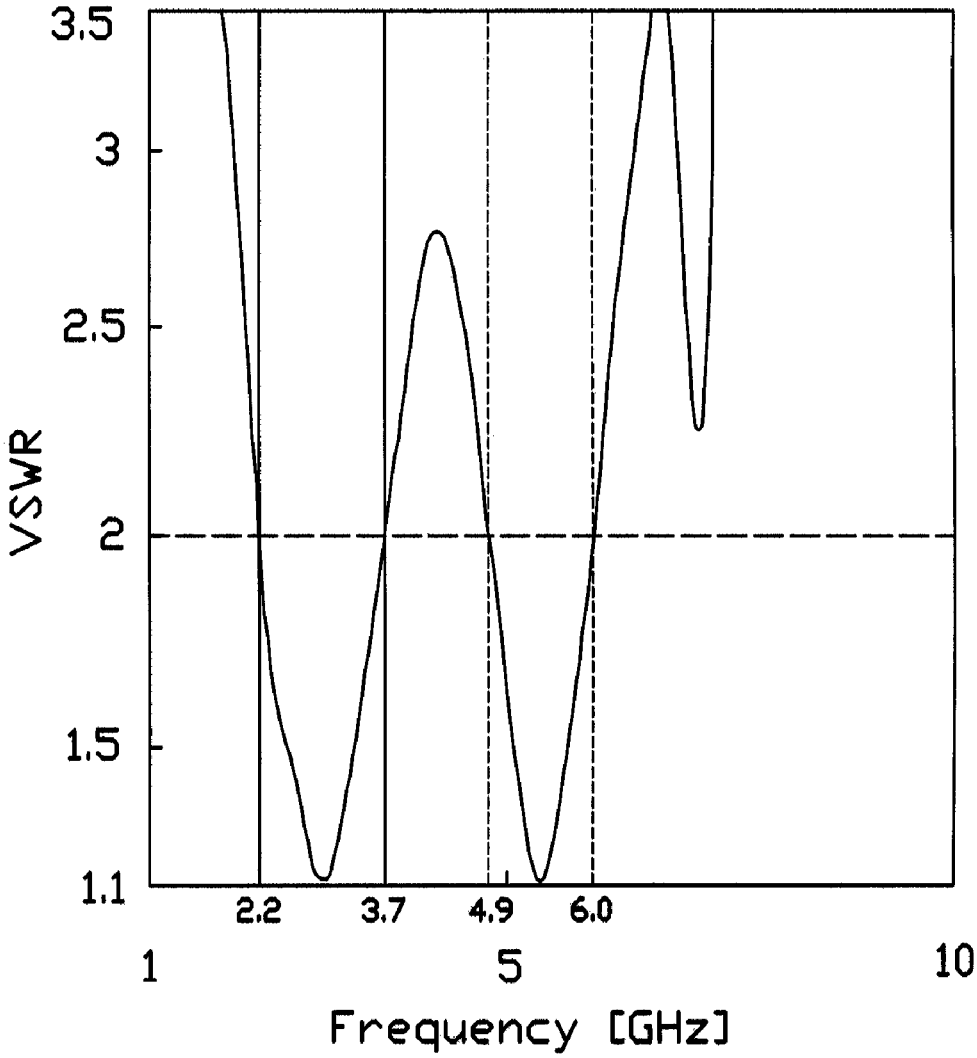
FIG. 7 is a graph of test results showing VSWR of a second dual-band antenna of the MIMO antenna of FIG. 4 and FIG. 5.

FIG. 7 is a graph of test results showing VSWR of the second dual-band antenna 22 of the MIMO antenna 20. A horizontal axis represents the frequency (in GHz) of the electromagnetic signals traveling through the second dual-band antenna 22, and a vertical axis represents amplitude of VSWR. A curve shows the amplitude of VSWR of the second dual-band antenna 22 at operating frequencies. As shown in FIG. 7, the second dual-band antenna 22 performs well when operating at frequency bands of 2.2-3.7 GHz and 4.9-6.0 GHz. The amplitude values of the VSWR in the band pass frequency range are smaller than a value of 2, indicating the second dual-band antenna 22 complies with application of IEEE 802.11a/b/g.

Figure 8:
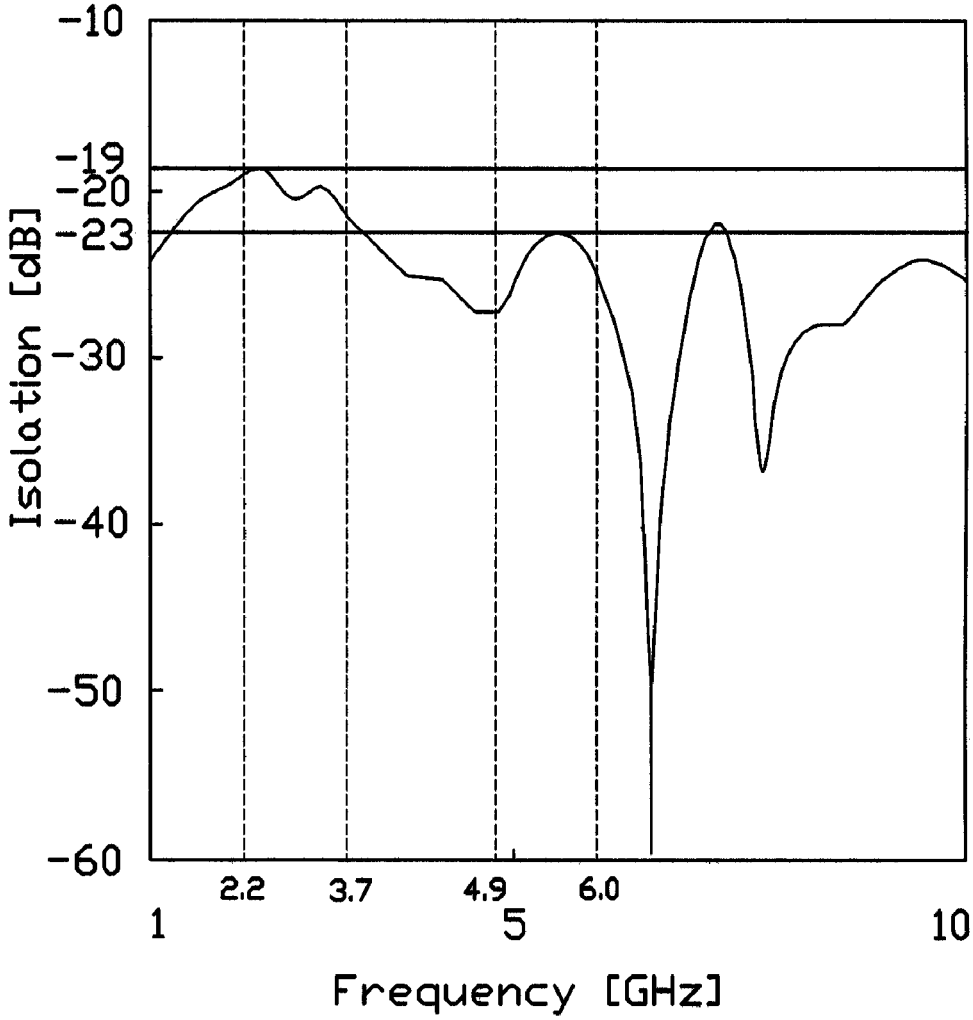
FIG. 8 is a graph of test results showing an isolation between the first dual-band antenna and the second dual-band antenna of the MIMO antenna of FIG. 4 and FIG. 5.

FIG. 8 is a graph of test results showing an isolation between the first dual-band antenna 21 and the second dual-band antenna 22 of the MIMO antenna 20. A horizontal axis represents the frequency (in GHz) of the electromagnetic signals traveling through the MIMO antenna 20, and a vertical axis represents the amplitude of the isolation. As shown in FIG. 8, a curve shows the isolation between the first dual-band antenna 21 and the second dual-band antenna 22 is at most substantially −19 dB when the MIMO antenna 20 operates at frequency band of 2.2-3.7 GHz. The isolation between the first dual-band antenna 21 and the second dual-band antenna 22 is at most substantially −23 dB when the MIMO antenna 20 operates at frequency band of 4.9-6.0 GHz. The isolation values of the two bands are smaller than −10, indicating the MIMO antenna 20 complies with application of IEEE 802.11a/b/g.

In this embodiment, the first radiation portion 120 and the second radiation portion 130 are disposed on different surfaces of the substrate 200, the first radiation portion 120 is arc-shaped, and the second radiation portion 130 is ring-shaped. Therefore, the area of the dual-band antenna 10 is reduced. The first grounded portion 140 improves the VSWR of the dual-band antenna 10 operating at a low frequency band. The second grounded portion 150 improves the VSWR of the dual-band antenna 10 operating at a high frequency band.

In this embodiment, the first radiation portion 120*a* (120*b*) and the second radiation portion 130*a* (130*b*) are disposed on different surfaces of the substrate 200*a*, the first radiation portion 120*a* (120*b*) is arc-shaped, and the second radiation portions 130*a* (130*b*) is ring-shaped. Therefore, the area of the MIMO antenna 20 is reduced. The first grounded portion 140*a* improves the VSWR of the first dual-band antenna 21 operating at a low frequency band. The second grounded portion 150*a* improves the VSWR of the first dual-band antenna 21 operating at a high frequency band. The first grounded portion 140*b* improves the VSWR of the second dual-band antenna 22 operating at a low frequency band. The second grounded portion 150*b* improves the VSWR of the second dual-band antenna 22 operating at a high frequency band. The first radiation portion 120*a* and the first radiation portion 120*b* are on two opposite sides of the vacant portion 170, and so the isolation between the first dual-band antenna 21 and the second dual-band antenna 22 is improved.

What is claimed is:

1. A dual-band antenna, disposed on a substrate comprising a first surface and a second surface, the dual-band antenna comprising:

a feeding portion, disposed on the first surface, for feeding electromagnetic signals;

a first radiation portion, disposed on the first surface, and electronically connected to the feeding portion;

a second radiation portion, disposed on the second surface, and electronically connected to the feeding portion;

a first grounded portion, disposed on one side of the feeding portion;

a second grounded portion, disposed on the other side of the feeding portion; and a connecting portion, for electronically connecting the first radiation portion, the second radiation portion, and the feeding portion;

wherein the first radiation portion is arc-shaped, and the second radiation portion is ring-shaped.

2. The dual-band antenna as recited in claim 1, wherein one end of the first radiation portion is electronically connected to the feeding portion, and the other end of the radiation portion is a free end.

3. The dual-band antenna as recited in claim 1, wherein projections of the first radiation portion and the second radiation portion on the substrate partially overlap.

4. The dual-band antenna as recited in claim 1, wherein the first grounded portion and the first radiation portion are disposed on the same side of the feeding portion.

5. The dual-band antenna as recited in claim 4, wherein a length of the first grounded portion is greater than that of the second grounded portion.

6. The dual-band antenna as recited in claim 1, wherein the connecting portion passes through the substrate.

7. A multi input multi output (MIMO) antenna disposed on a substrate comprising a first surface and a second surface, the MIMO antenna comprising a first dual-band antenna and a second dual-band antenna symmetrically defined on the substrate, the first dual-band antenna and the second dual-band antenna each comprising:

a feeding portion, disposed on the first surface, for feeding electromagnetic signals;

a first radiation portion, disposed on the first surface, and electronically connected to the feeding portion;

a second radiation portion, disposed on the second surface, and electronically connected to the feeding portion;

a first grounded portion, disposed on one side of the feeding portion;

a second grounded portion, disposed on the other side of the feeding portion; and a connecting portion, for electronically connecting the first radiation portion, the second radiation portion, and the feeding portion.

8. The MIMO antenna as recited in claim 7, wherein the first radiation portion is arc-shaped, and the second radiation portion is ring-shaped.

9. The MIMO antenna as recited in claim 7, wherein one end of the first radiation portion is electronically connected to the feeding portion, and the other end of the first radiation portion is a free end.

10. The MIMO antenna as recited in claim 7, wherein projections of the first radiation portion and the second radiation portion on the substrate partially overlap.

11. The MIMO antenna as recited in claim 7, wherein the connecting portion passes through the substrate.

12. The MIMO antenna as recited in claim 7, wherein the first grounded portion and the first radiation portion are disposed on the same side of the feeding portion.

13. The MIMO antenna as recited in claim 12, wherein a length of the first grounded portion is greater than that of the second grounded portion.

14. The MIMO antenna as recited in claim 12, wherein the feeding portion of the first antenna is substantially parallel to that of the second antenna, and a vacant portion is formed therebetween.

15. The MIMO antenna as recited in claim 14, wherein the first radiation portion of the first dual-band antenna and the vacant portion are respectively located at two opposite sides of the feeding portion of the first dual-band antenna.

16. The MIMO antenna as recited in claim 15, wherein the first radiation portion of the second dual-band antenna and the vacant portion are respectively located at two opposite sides of the feeding portion of the second dual-band antenna.

17. The MIMO antenna as recited in claim 16, wherein the second grounded portion of the first dual-band antenna is parallel to the second grounded portion of the second dual-band antenna, and the second grounded portion of the first dual-band antenna and the second grounded portion of the second dual-band antenna are disposed in the vacant portion.

* * * * *